United States Patent [19]

Strong

[11] Patent Number: 4,673,413

[45] Date of Patent: Jun. 16, 1987

[54] APPARATUS FOR GASIFYING WASTE OIL

[76] Inventor: William A. Strong, 394 Graham Rd., South Windsor, Conn. 06074

[21] Appl. No.: 730,453

[22] Filed: May 6, 1985

[51] Int. Cl.[4] ..... C10G 9/04

[52] U.S. Cl. ..... 48/105; 48/94; 196/111; 196/127

[58] Field of Search ..... 48/89, 98, 99, 102 R, 48/102 A, 105, 94, 90, 119, 180, 1, 189.4; 123/3, 557; 122/5; 196/104, 110, 111, 115, 125, 127, 14.52

[56] References Cited

U.S. PATENT DOCUMENTS

| | | | |
|---|---|---|---|
| 306,311 | 10/1884 | Ambler | 48/94 |
| 868,205 | 10/1907 | Meyer | 48/94 |
| 1,462,678 | 7/1923 | Adams | 196/110 |
| 1,529,030 | 3/1925 | Lindsay | 196/127 |
| 2,744,814 | 5/1956 | Francis | 48/105 |
| 2,769,772 | 11/1956 | Gomory | 196/110 |

*Primary Examiner*—Barry S. Richman
*Assistant Examiner*—Joye L. Woodard
*Attorney, Agent, or Firm*—Arthur T. Fattibene

[57] ABSTRACT

An apparatus for treating carbonaceous material, e.g. waste oil by effecting the gasification thereof to produce a relatively high BTU content gas to supplement or substitute for natural gas. This is attained by a furnace in which the products of combustion are utilized to separately generate steam and to preheat a supply of carbonaceous material which may be mixed with water. The generated steam is mixed with the preheated carbonaceous material and passed through a premixing and/or a primary dynamic mixer wherein the preheated carbonaceous material and steam mixture is further heated to a temperature ranging between 1600°–1800° F. to effect a partial gasification of the carbonaceous material. The partially gasified material is thereafter directed through one or more secondary dynamic mixing chambers to be further heated in the presence of additional steam to complete the gasification thereof. The generated gases are thereafter scrubbed and washed to remove any solid residue and thereafter passed through a condensor to effect the removal of any residual water; and from which the condensed gases are collected and/or stored for future use.

7 Claims, 4 Drawing Figures

APPARATUS FOR GASIFYING WASTE OIL

BACKGROUND OF THE INVENTION

In view of the increasing awareness of improving the ecology, it has been observed that the disposing of used or waste oil and other types of carbonaceous material presents a considerable ecological problem. Waste oil, e.g. oil that has been used in a manufacturing process and which has been contaminated with water, machine filings and other matter generally does not render such waste oil suitable for recycling. Heretofore, such used or waste oil was simply discarded. Invariably, such discarded waste oil would eventually find its way to some land fill or dump, only to pollute the surrounding area, seeping into the underground water source and the like. Frequently, even reclaimable oil is simply discarded.

In addition to the ecological problems presented by the abundance of waste oil and/or other types of carbonaceous materials, there exists a related energy crisis, viz., the progressive deterioration of the available oil and/or natural gas reserves, as more and more oil and gas is used.

As a result, many efforts have been made to supplement the natural oil and gas reserves by producing a gas substitute from coal. A number of coal gasification processes are known, e.g. as disclosed in U.S. Pat. Nos. 3,124,435 and 4,101,295. The teaching of these patents are primarily directed to a method and apparatus for effecting the gasification of coal to produce a gas substitute.

Efforts have also been made to reform hydrocarbons into gaseous products as evidenced in U.S. Pat. Nos. 3,945,805 and 3,945,806.

OBJECTS

An object of this invention is to provide a method and apparatus for treating used or waste oil in an ecologically acceptable manner and for producing a high BTU content gas substitute.

Another object is to provide a method and apparatus for effecting the gasification of waste oil to produce a high BTU gas substitute; which when burned is environmentally clean.

Another object is to provide a non-catalytic process for effecting the gasification of waste oil and other types of carbonaceous materials and/or toxic materials.

Another object is to provide low pressure, pyrolitic process for effecting the gasification of carbonaceous materials that is environmentally clean with respect to its emissions from its feed stock.

Another object is to provide a method and apparatus for reforming organic carbonaceous material to produce a usable gas.

SUMMARY OF THE INVENTION

The foregoing objects and other features and advantages are attained by a method and apparatus for treating organic carbonaceous material, e.g. waste oil to produce therefrom a high BTU content gas substitute in a low pressure pyrolitic manner. This is attained in a furnace which is suitably fired to effect the separate preheating of the carbonaceous material and the generation of steam. The carbonaceous material is mixed with water and this mixture is initially pre-heated to a temperature of 200° to 600° F. and thereafter mixed with steam. The preheated material and steam mixture in one embodiment is directed to a primary dynamic mixing chamber disposed within the furnace for heating the mixture to a range of 1600° to 1800° F. The mixture may then be passed through one or more secondary mixing chambers wherein supplementary steam is added to the mixture just prior to entering the respective secondary chambers wherein the mixture is further heated to a temperature of 1800° to 2200° F.

The gases generated from the carbonaceous material in passing through the mixing chamber exit to a washing station where the solid residues are precipitated out. Upon washing of the generated gases, the washed gases flow through a condensor wherein the gases are cooled and the moisture carried along therewith is condensed. The cooled gases are then collected and stored for subsequent use, a portion of which may be used to fire the furnace. In accordance with this invention, the respective primary and secondary chambers are uniquely constructed so as to enhance the mixing action as the temperature of the waste oil and associated steam mixed therewith are heated to the temperature sufficient to effect the gasification.

In another embodiment, the initial preheated carbonaceous material and steams are introduced into a premixing chamber wherein the carbonaceous material and steam are intimately mixed and preheated to a temperature ranging between 1500°–1700° F. From the premixing chamber, the mixture is directed to serially connected primary and secondary heating chambers where the carbonaceous material is finally heated and gasified to a temperature of 1800°–2200° F.

FEATURES

A feature of this invention resides in an apparatus for effecting the gasification of carbonaceous material, e.g. waste oil.

Another feature resides on a pyrolitic, non-catalytic generator for processing organic carbonaceous material in an ecological manner.

Another feature resides in a method for effecting the gasification of an organic carbonaceous material, e.g. waste oil to produce a high BTU gas.

Another feature resides in the provision of a generator for treating waste oil having a mixing chamber constructed so as to enhance the mixing of the gases flowing through the generator.

BRIEF DESCRIPTION OF THE DRAWINGS

Other features and advantages will become readily apparent when considered in view of the drawings and specifications in which.

DETAILED DESCRIPTION

Figure 1:
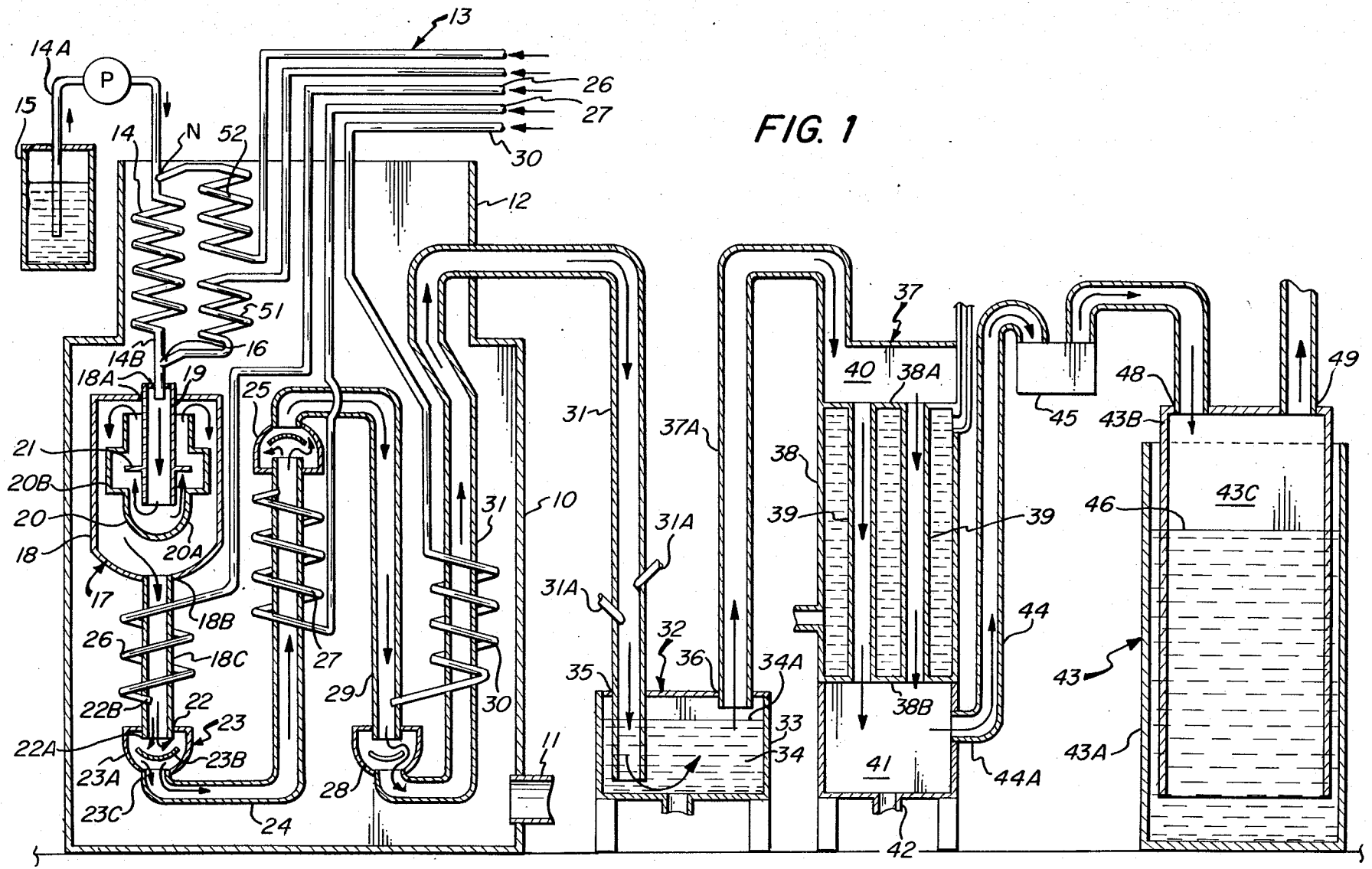
FIG. 1 is a schematic view of an apparatus embodying the invention.

Referring to the drawings, there is shown in FIG. 1, a diagramatic representation of an apparatus to effect the handling and/or gasification of organic carbonaceous material. It will be understood that such carbonaceous material may comprise coal, oil, either reclaimable and/or waste oil, methane, propane, and such other material which may contain PCB or other toxic materials. For purposes of description only, reference will be made to used or waste oil. Oil used in machine shops to facilitate machining operations is a typical kind of waste oil. Such oil is often contaminated with a relatively large proportion of water and/or metal filings and/or chips. Such other waste oil may comprise oil drained from vehicles or the like.

The apparatus for handling such waste oil in accordance with this invention, comprises a furnace 10 which may be suitably fired by one or more burners 11, e.g. gas burners or the like. The upper end of the furnace 10 connects to a flue or stack portion 12, which connects to a chimney to which the combustion gases are exhausted to atmosphere. Disposed in the flue or stack portion 12 of the furnace are one or more banks of steam generating tubes 13. Also disposed within the flue or stack portion of the furnace 10 is a coil 14, through which the waste oil is directed. One end 14A of coil 14 connects to the waste oil supply 15. The other end 14B of coil 14 is in communication with a steam nozzle 16 at the end of steam tubes 13. The waste oil is pumped from its supply 15 and through coil 14 past a spray nozzle 16 which is steam driven. The steam nozzle 16 is connected adjacent the end 14B of the supply coil 14 in communication with a primary mixing chamber 17 which is disposed within the furnace 10. The nozzle 16 is fed by steam generated in coil S1, which is arranged to atomize the oil in coil 14 as it enters chamber 17.

In the illustrated embodiment, the primary dynamic heating and mixing chamber 17 comprises an outer shell 18 which is closed at opposite ends, except for an inlet 18A and outlet 18B. The inlet 18A comprises a tubular member 19 that extends into shell 18 and which is open at its lower end. Disposed between the outer shell 18 and conduit 18 is an intermediate shell 20, which has a closed lower end 20A spaced from the outlet end of tubular member 19. The intermediate portion 20B is provided with an enlarged portion to accommodate a baffle 21 which circumscribes the tubular member 19. Thus, as noted by the arrows, the mixture of waste oil and steam upon entering the inlet 18A is directed down the tubular member 19 to make a series of passes within the primary mixing chamber. The tortuous path thus defined by the tubular member 19, the intermediate shell 20 and outer shell 18 enables the oil and steam to thoroughly mix while being heated to a temperature ranging between 1600° to 1800° F. as it flows therethrough. If desired, a booster steam coil S2 is provided for generating steam used to boost the oil through coil 14. The booster steam is introduced into the oil coil 14 through a spray nozzle N.

The outlet end 18B of the primary chamber 18 connects in communication with the inlet 22 of a secondary dynamic heating and mixing chamber 23. The secondary chamber 23 comprises an outer shell 23A and an inner shell 23B spaced therefrom, the latter being spaced from the extended portion 22A of the inlet 22. The outer shell 23A is provided with an outlet 23C which connects to a conduit 24 which connects to a second, secondary heating and mixing chamber 25.

A second steam coil 26 is disposed in the furnace to be heated by the combustion gases, and it is coiled about the conduit 18C interconnecting the outlet 18B of the primary chamber 18 to the inlet of the secondary chamber 23. The steam generated in coil 26 is introduced into the inlet of the secondary chamber at 22B to mix with the waste oil and steam mixture leaving the primary chamber 17. Connected in series with secondary chamber 23 is a second secondary chamber 25 which is constructed like the first described secondary chamber 23. A third steam coil 27 is disposed in the furnace to be heated by the combustion gases therein, and it is coiled about the conduit 24 leading to the second secondary chamber 25. Steam coil 27 is arranged to add supplemental steam to the mixture entering the inlet of the second secondary chamber 25. The described apparatus may be provided with a third secondary chamber 28, which is serially connected to the second secondary chamber 25 by an interconnecting conduit 29, and a fourth steam coil 30 is provided for adding additional steam to the mixture entering the third secondary chamber 28.

It is to be noted that the respective secondary chambers 23, 25 and 28 are serially connected and each is provided with a steam coil for adding steam to the medium flowing from the preceding mixing chamber. In the illustrated embodiment, the fourth steam coil 30 is coiled about the conduit 31, which is connected to the outlet end of the mixing chamber 28, or last secondary mixing chamber.

Mixing chambers 23, 25 and 28 are similarly constructed and each is arranged to effect a mixing of the medium flowing therethrough and which cumulatively provides the requisite residence time within the furnace, necessary for the waste oil to be gasified into its gaseous constituents wherein the material to be gasified is heated to a final temperature ranging between 1800° to 2200° F.

Upon exiting from the last mixing chamber 28, conduit 31 directs the gaseous products to a washing station 32. The washing station 32 is shown as a container 33 for holding a supply or body of water 34 having a water level 34A. The container 33 is provided with a gas inlet 35 and a gas outlet 36. It will be noted that the gas inlet extends into the washing station so that its outlet is located below the water level 34A. Thus, as the gaseous products enter the washer, the discharged gases are washed by the water, causing any solid residue within the gaseous medium to be precipitated out. The gaseous products relieved of their solid particles or residue flow through the outlet and to a condensing station 37 by way of conduit 37A. If desired, the gases generated can be precooled prior to entering the washing station 32 by providing a series of water spray nozzles 31A in communication with conduit 31 upstreamwise from the washer as shown in FIG. 1. It will be understood that nozzles 31A are connected to a suitable source of water supply.

The condensing station 37 comprises a vessel 38 having spaced apart headers 38A and 38B interconnected by a series of tubes 39 which interconnect an upper header chamber 40 to a lower chamber 41. Between the headers 38A and 38B and surrounding the tubes 39 is a cooling medium, e.g. water. Thus, as the washed gases pass through tubes 39, they are cooled by the surrounding water or cooling medium, thereby causing any moisture content within the generated gases to condense, the condensate being collected in the lower header chamber 41 from which the water or condensate is removed through a suitable drain 42.

The gas thus cooled exits the lower header chamber 41 and are directed to a collecting tank 43 through conduit 44. Disposed between the outlet 44A of the lower header and the collecting tank 43 is a meter 45 to measure the amount of gases generated.

The collecting tank 43 comprises an outer tank 43A containing a water level 46 and an inverted open end inner tank 43B, which is rendered movable relative to the outer tank 43A. The top of the inner tank 43B is provided with an inlet 48 and an outlet 49. The arrangement is such that as the gases generated enter into the upper end of the inner tank 43B, above the water level 46, the inner tank 43B defines an expandible chamber 43C for storing the generated gas until used. It will be understood that a portion of the generated gases may be used to fire the gas burners 11 for generating the products of combustion necessary to effect the gasification of the waste oil.

Figure 2:
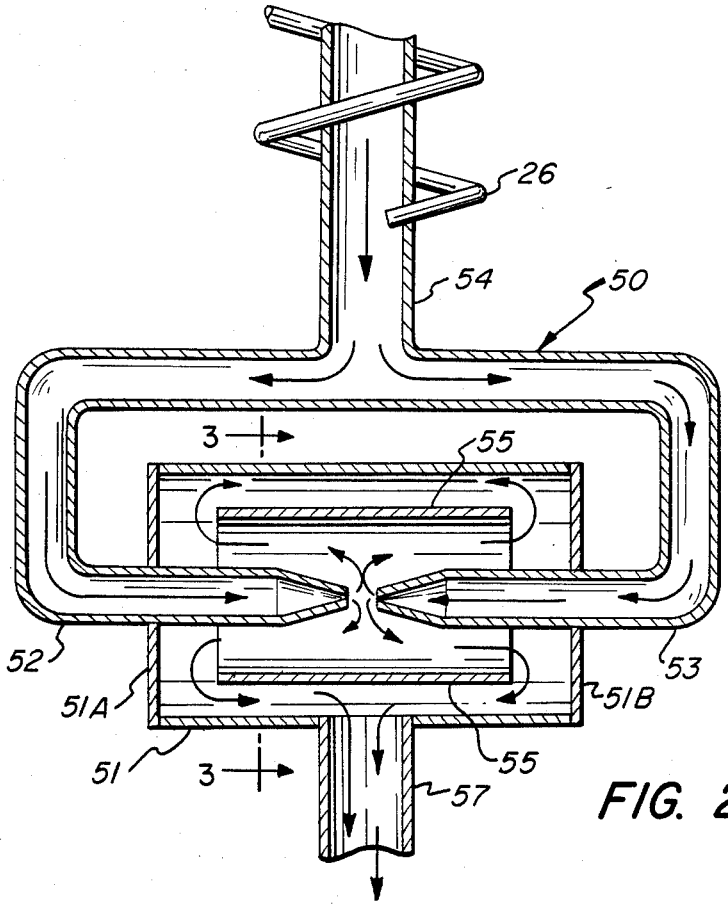
FIG. 2 is an alternate construction of a secondary mixing chamber.
Figure 3:
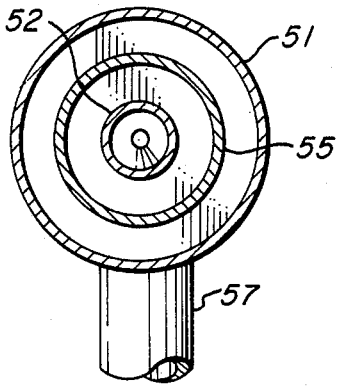
FIG. 3 is a sectional view taken on line 3—3 on FIG. 2.

FIGS. 2 and 3 illustrate a modified embodiment of a secondary mixing chamber 50, which may be utilized in the apparatus described in lieu of secondary chambers 23, 25 and 28 herein described.

As shown, the modified construction of secondary chamber 50 comprises an outer tubular shell 51, which has closed ends 51A and 51B, except for opposed inlets which connect with conduits 52 and 53 which branch off in opposite directions from the connecting conduit 54, for connecting the secondary chamber 51 to the primary mixing chamber or to preceding secondary chamber as herein described. A steam coil 26 is located contiguous to conduit 54 for directing supplemental steam to the generated gases products flowing through conduit 54 prior to entering the secondary chamber 51.

Disposed within the secondary mixing chamber 51 is a tubular inner shell 55 disposed in spaced relationship to the outer shell 51 to define open end passes within the chamber. As shown, the inlet of conduits 52 and 53 are directed toward one another whereby the gases discharging therefrom are caused to impinge on one another to provide a thorough mixing action, and whereby the gases are directed through the passages defined between the inner and outer shells 55 and 51 respectively, as the gases flow to the outlet 57, which directs the gases to the next succeeding secondary mixing chamber as herein described or to the washer 32 as the case may be.

It will be understood that the system described can be constructed with either type of secondary mixing chamber 23 or 51, disposed in series, as herein described, so as to provide for the necessary residence time to effect the gasification of the waste oil in passing through the heating chamber of the furnace. By providing a primary chamber 17 and a plurality of secondary mixing chambers in a series and utilizing the construction herein described further enables the size of the furnace to an optimum minimum.

Figure 4:
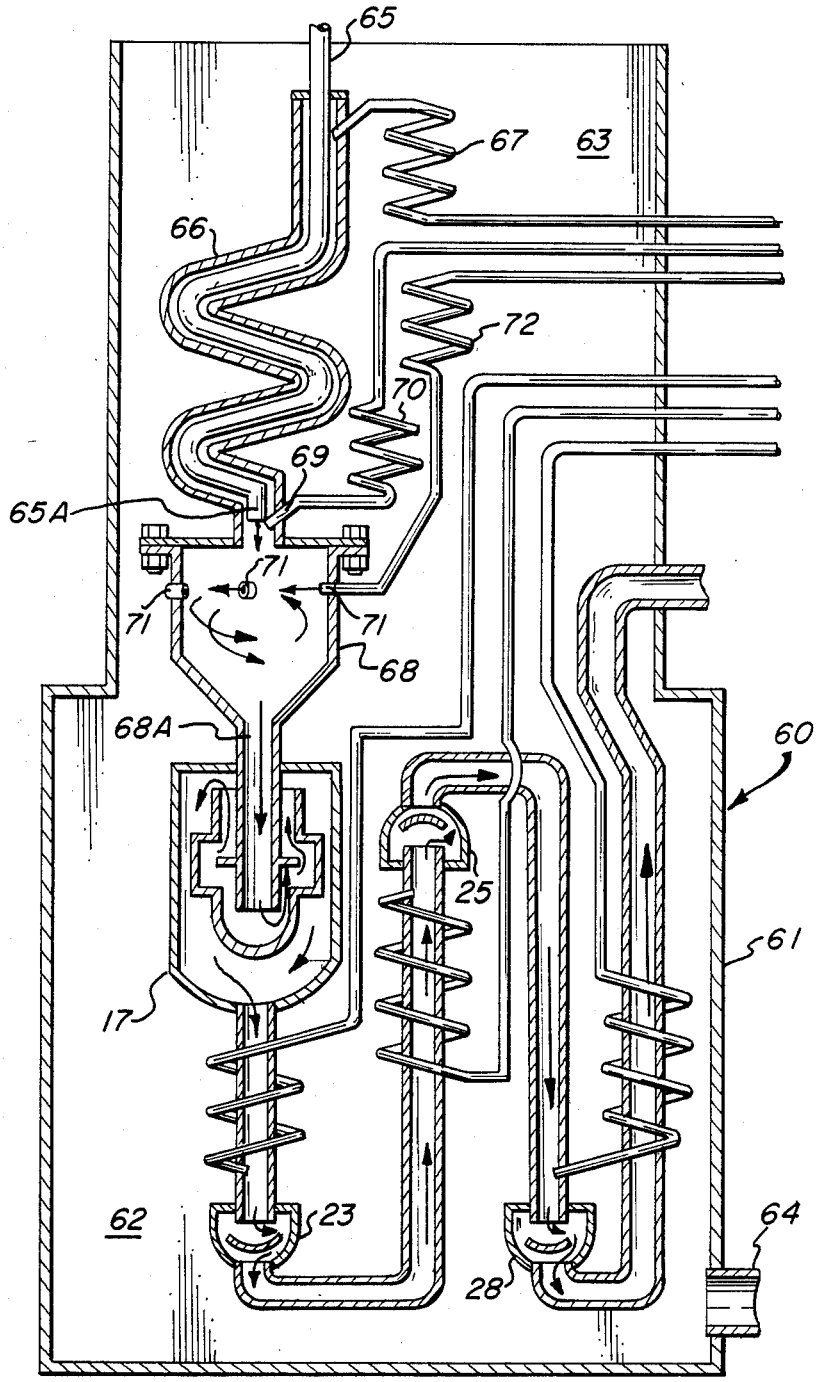
FIG. 4 is a schematic side view of a modified embodiment.

FIG. 4 illustrates a modified furnace arrangement for use in the system shown in FIG. 1. The modified furnace arrangement 60 of FIG. 4 comprises the furnace walls 61 to define the furnace primary heating furnace chamber 62 and the secondary heating portion 63, leading to the stack.

As hereinbefore described, the furnace chamber 62 is fired by one or more burners 64, preferably gas burners. In this form of the invention, the organic carbonaceous material to be gasified, e.g. oil, coal or the like, is delivered to the furnace through a supply conduit 65 which connects to a source of supply as hereinbefore described; and therefore not shown in FIG. 4.

The supply conduit 65 extends in a coil or unulating manner into the secondary heating chamber 63 of the furnace 60 to be preheated therein. In this form of the invention, the coils of the supply conduit 65 are jacketed by a complementary steam jacket 66 and which jacket is supplied with steam generated in a steam coil 67.

The supply conduit 65 and its steam jacket 66 are axially connected to the top of a mixing pre-heat chamber 68. A steam nozzle 69 connected to a steam coil 70 is disposed adjacent to outlet 65A of the supply conduit to supply supplemental steam to the material to be gasified. One or more steam nozzles 71 are tangentially disposed about the pre-heating chamber for introducing steam generated in coils 72 tangentially about the premixing chamber 68. For the foregoing, it will be noted that the axially introduced mixture through conduit 65A is impinged upon by a plurality of tangential steam nozzles 71 to provide for intimate mixing and a preheating of the medium to be gasified. The arrangement is such that the medium to be gasified, e.g. oil, is heated to a temperature of 1500°–1700° F.

From the pre-heating chamber 68 describes the preheated medium is directed from the chamber's outlet 68A to the primary heating chamber 18 which is similar to that described with respect to FIG. 1. In all other respects, the apparatus to be utilized with the furnace 60 of FIG. 4 is similar to that described with respect to FIG. 1, and need not be further described.

The embodiments herein disclosed operate at relatively low pressures, e.g. 5 to 35 psi; and they are extremely safe in that the system will not explode even if a tube rupture occurs. In the event of a tube rupture, the generated gases will merely burn and not explode.

From the foregoing, it will be noted that the described apparatus enables the effecting of an efficient pyrolitic process for the treating of organic carbonaceous material so as to effect the gasification thereof in an ecological manner. While the apparatus has been particularly described with respect to effecting the gasification of oil, the same apparatus and method herein set forth can be utilized to effect the gasification of coal or any other organic type carbonaceous material, either separately and/or in combination. Thus, the apparatus is capable of generating a usable gas substitute from any organic hydrocarbon material.

A chemical analysis of one oil gasified by the foregoing described apparatus and method defined disclosed the following chemical components and concentration by volume.

| Chemical Component Methane | Concentration Percent by Volume |
|---|---|
| Methane | 33 |
| Water | 0.9 |
| Ethylene | 16 |
| Ethane | 3.5 |
| Propene | 3.8 |
| Butadiene | 1.4 |
| Cyclopentadiene | 3.5 |
| Benzene | 14 |
| Toluene | 0.7 |
| Carbon Dioxide | 23 |
| Others | 0.2 |
| | 100.0 |

The test conducted did not reveal the presences of any chlorine or sulfur containing components that could result in hydrogen chloride or sulfur dioxide formation on combustion.

While the invention has been described with respect to several embodiments thereof, it will be understood and appreciated that variations and modifications may be made without departing from the spirit or scope of the invention.

What is claimed is:

1. An apparatus operating at relatively low pressure ranging between 5 to 35 psi for effecting the gasification of an organic carbonaceous material comprising;

a furnace for effecting the generation of combustion gases, said furnace having a primary heating chamber and a secondary heating chamber, burner means for firing said furnace, a primary dynamic mixer disposed in said primary heating chamber of said furnace, a secondary dynamic mixer serially connected to said primary dynamic mixer, supply means for introducing an organic carbonaceous material to be gasified into said primary dynamic mixer, said supply means including a coil disposed in said secondary heating chamber for effecting a preheating of said carbonaceous material flowing therethrough prior to introduction into said primary dynamic mixer, means for adding steam to said preheated carbonaceous material in advance of said primary dynamic mixer, means disposed within said primary mixer to define a tortuous path for the material flowing therethrough, whereby said material is mixed with said steam and heated to a temperature ranging between 1600° to 1800° F., said primary dynamic mixer having an outlet means, said secondary dynamic mixer being connected to said outlet means, a first steam coil disposed in said furnace, said first steam coil being connected to said outlet means for introducing additional steam to the heated carbonaceous material flowing into said secondary dynamic mixer wherein said heated carbonaceous material is heated to a temperature ranging between 1800° to 2200° F., a washer means connected to said secondary dynamic mixer for washing the gases resulting from the heating of the carbonaceous material in said primary and secondary dynamic mixers, a condensing means connected to said washing means for condensing the moisture out of said gases flowing therethrough, and a collector for receiving and storing the moisture freed gases.

2. An apparatus as defined in claim 1 and including a second secondary dynamic mixer serially connected to said secondary dynamic mixer, said second secondary dynamic mixer being disposed between said secondary dynamic mixer and said washer, and a second steam coil disposed in said furnace, said second steam coil being connected for introducing additional steam to the material flowing through said second secondary dynamic mixer.

3. An apparatus for effecting the gasification of an organic carbonation material comprising;

a furnace for effecting the generation of combustion gases, said furnace having a primary heating chamber and a secondary heating chamber, burner means for firing said furnace, a primary dynamic mixer disposed in said primary heating chamber of said furnace, a secondary dynamic mixer serially connected to said primary dynamic mixer, supply means for introducing an organic carbonaceous material to be gasified into said primary dynamic mixer, said supply means including a coil disposed in said secondary heating chamber for effecting a preheating of said carbonaceous material flowing therethrough prior to introduction into said primary dynamic mixer, means for adding steam to said preheated carbonaceous material in advance of said primary dynamic mixer, means disposed within said primary mixer to define a tortuous path for the material flowing therethrough, whereby said material is mixed with said steam and heated to a temperature ranging between 1600° to 1800° F., said primary dynamic mixer having an outlet means, said secondary dynamic mixer having an inlet connected to said outlet means, a steam coil disposed in said furnace, said steam coil being connected to said outlet means for introducing additional steam to the heated carbonaceous material flowing into said secondary dynamic mixer wherein said heated carbonaceous material is heated to a temperature ranging between 1800° to 2200° F., a washer means connected to said secondary dynamic mixer for washing the gases resulting from the heating of the carbonaceous material in said primary and secondary dynamic mixers, a condensing means connected to said washing means for condensing the moisture out of said gases flowing therethrough, and a collector for receiving and storing the moisture freed gases, wherein said primary dynamic mixer comprises an outer shell having an inlet end and an outlet end, a tubular member extending through said inlet end, said tubular member extending longitudinally into said outer shell and having an end terminating within said outer shell, an intermediate shell disposed between said tubular member and said outer shell in spaced relationship thereto, said intermediate shell having a closed end spaced from said end of said tubular member, and a baffle connected to an outer surface of said tubular member and extending normal thereto, whereby said tortuous flow path is defined within said primary dynamic mixer.

4. An apparatus as defined in claim 3 wherein said second dynamic mixer comprises an outer tubular shell having closed ends, said outer tubular shell having an outlet formed therein, a conduit connecting said inlet of the secondary dynamic mixer to the outlet means of said primary dynamic mixer, said conduit including a branch conduit portion having opposed inlets extending through said closed ends, an inner tubular shell disposed within said outer tubular shell and spaced therefrom, said inner tubular shell having open ends through which said opposed inlets extend.

5. An apparatus for effecting low pressure gasification of an organic carbonaceous material comprising a furnace having burner means for generating products of combustion, supply means for introducing material to be gasified into a coil for preheating the material, said coil disposed in said furnace in heat transfer relationship to the products of combustion, a steam coil connected to said preheating coil for spraying steam into the material flowing therethrough, a primary mixing chamber connected to said preheating coil for receiving the preheated material and steam mixture, means disposed within said primary mixing chamber for imparting a tortuous flow path to the mixture flowing therethrough, a plurality of serially connected secondary mixing chambers disposed in said furnace, wherein a first of said plurality of serially connected secondary mixing chambers is connected to said primary mixing chamber downstream thereof, each of said plurality of serially connected secondary mixing chambers having an inlet for receiving the heated mixture and a steam coil connected thereto for spraying additional steam into said mixture, a gas washing means connected to the last of said plurality of secondary mixing chambers, a condensing means downstream of and connected to said washer means, and a gas collecting means connected to said condensing means for receiving and storing gases.

6. An apparatus as defined in claim 5 wherein said steam coil connected to said preheating coil defines a jacket about said preheating coil, a mixture preheat chamber disposed unstream of and connected to said primary mixing chamber, said jacketed preheating coil disposed upstream of and connected to said mixing preheat chamber, a nozzle means tangentially disposed relative to said mixing preheat chamber, and a steam coil connected to said nozzle means for spraying steam through said nozzle means into said mixing preheat chamber.

7. An apparatus as defined in claim 6 wherein said nozzle including a plurality of nozzles tangentially disposed about said mixing preheat chamber.

* * * * *